US006543547B2

(12) United States Patent
Neumeir et al.

(10) Patent No.: US 6,543,547 B2
(45) Date of Patent: Apr. 8, 2003

(54) PORTABLE FOAM FIRE EXTINGUISHER WITH PRESSURED GAS FOAM

(76) Inventors: Anton Neumeir, Hagenbuchstrasse 20, 86415 Mering (DE); Reinhard Effenberger, Untere Jägerstrasse 3, 86444 Anwaiting (DE)

( * ) Notice: Subject to any disclaimer, the term of this patent is extended or adjusted under 35 U.S.C. 154(b) by 0 days.

(21) Appl. No.: 09/974,341

(22) Filed: Oct. 10, 2001

(65) Prior Publication Data

US 2002/0040789 A1 Apr. 11, 2002

(30) Foreign Application Priority Data

Oct. 10, 2000 (DE) ..... 100 49 998

(51) Int. Cl.[7] ..... A62C 11/00

(52) U.S. Cl. ..... 169/30; 169/9; 169/14; 169/71; 169/85

(58) Field of Search ..... 169/9, 14, 30, 169/71, 85

(56) References Cited

U.S. PATENT DOCUMENTS 3,337,195 A * 8/1967 Farison ..... 169/15
4,318,443 A * 3/1982 Cummins ..... 169/15
4,981,178 A 1/1991 Bundy
5,415,352 A * 5/1995 May ..... 239/346
5,623,995 A 4/1997 Smagac
6,223,827 B1 * 5/2001 Zuev et al. ..... 169/14

FOREIGN PATENT DOCUMENTS

| | | |
|---|---|---|
| DE | 26 30 519 | 1/1978 |
| DE | 196 46 562 | 5/1998 |
| DE | 198 45 282 | 6/2000 |
| EP | 0 088 029 | 9/1983 |
| EP | 0 828 535 | 8/2000 |
| FR | 2 575 082 | 6/1986 |
| WO | WO 9851374 A2 * | 11/1998 |

* cited by examiner

*Primary Examiner*—Robin O. Evans
(74) *Attorney, Agent, or Firm*—Klaus J. Bach

(57) ABSTRACT

In a portable foam fire extinguisher with pressurized foam stabilization, including a container for the fire extinguishing medium, a pressurized gas bottle in communication with the container and a fire extinguisher gun connected to the container by a hose for supplying the fire extinguishing medium to the fire extinguisher gun, a mixing device is connected, by way of a pressure hose, to the pressurized gas bottle for admixing pressurized gas to the flow of the fire extinguishing medium to the fire extinguisher gun to provide therein pressurized gas bubbles, which expand when the mixture is discharged from the gun thereby accelerating the flow from the gun while forming a foam which adheres to the surfaces covered thereby.

3 Claims, 1 Drawing Sheet

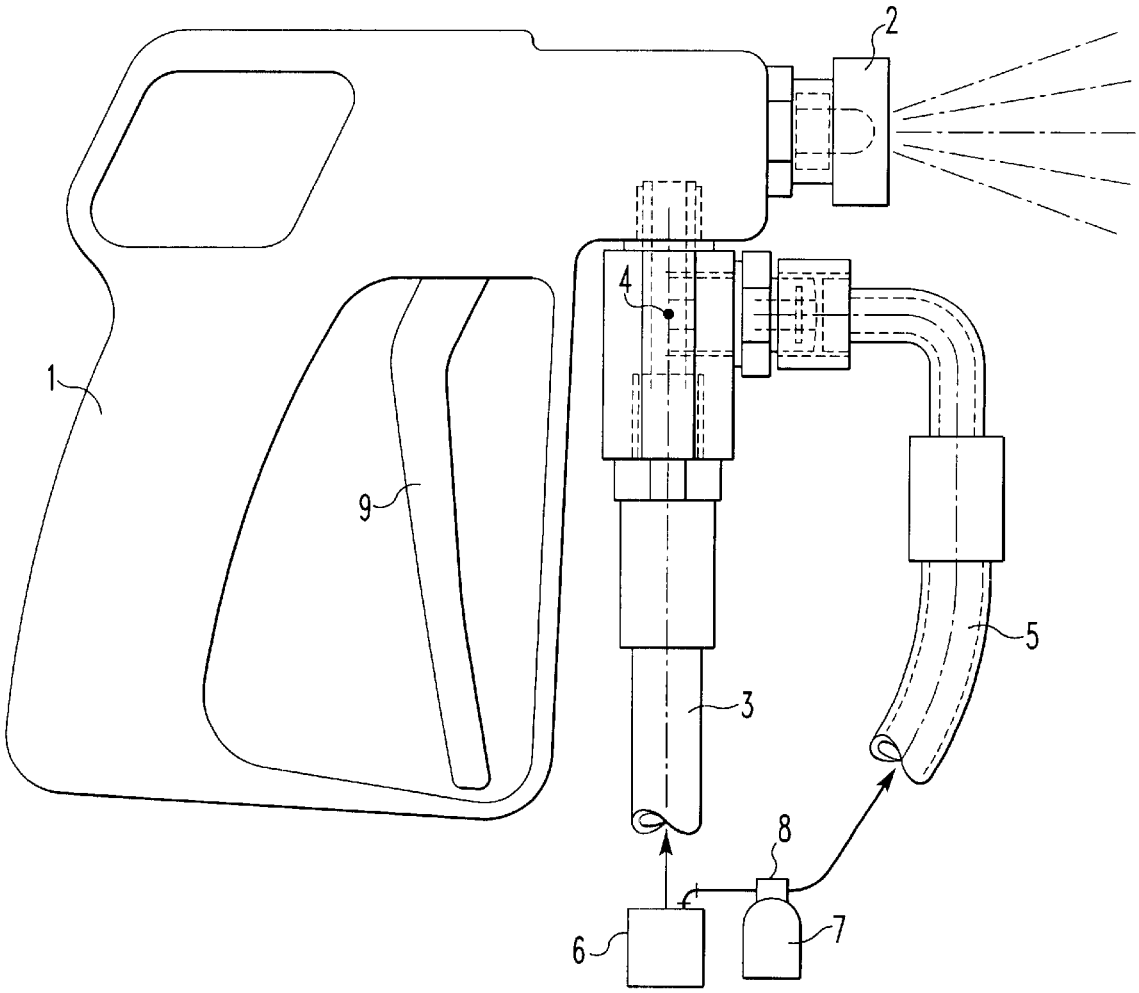
2
4
1
9
5
3
8
6
7

PORTABLE FOAM FIRE EXTINGUISHER WITH PRESSURED GAS FOAM

BACKGROUND OF THE INVENTION

The invention relates to a portable foam fire extinguisher which generates pressurized gas stabilized fire extinguishing foam.

Fire extinguishing systems which empploy pressurized gas stabilized foam are basically known. They are designated in the art as CAFS, which stands for Compressed Air Foam System.

The first compressed air foam apparatus were built as fire extinguishing apparatus already in the 1930's. In the same period, a portable fire extinguisher with a compressor flanged thereto for generating pressure-foam was built at one time.

Today's CAFS fire extinguishers employ, for the generation of the compressed air needed for the foam formation, a compressor adapted to pressurize the air, which is supplied to the extinguisher medium flow at a pressure of about 7 to 10 bar. The extinguisher medium consists of water to which a foaming agent has been added. With the admission of the compressed air to the extinguisher medium flow, which is transported by a pump, additional energy is delivered to the extinguisher medium flow. This provides for a substantially increased distance for the medium discharged from the nozzle and also for a highly homogeneous foam bubble structure with an adhesion capability not known earlier. CAFS is a further development of the foam extinguishing process using water with an addition of class-A foam (wetting medium). CAFS can be used for extinguishing class A fires (solid material fires) as well as class B fires (liquid fires). With environmentally compatible foam media, low foam medium consumption (admixed to water at a rate of 0.1 to 10%); savings in extinguisher water and substantially more effective fire extinguishing capability, there is furthermore a positive environmental balance. Tests have shown that with the use of CAFS, the water consumption for extinguishing a fire can be reduced to about one sixth when compared with conventional extinguishing processes. At the same time, the safety for the firemen is increased and the stress to which they are subjected is reduced.

A CAFS system exists up to this point of the components: a fire extinguisher centrifugal pump for pumping water, an air compressor for producing compressed air and a foam admixing system for the admixing of a foaming agent and the respective controls. CAFS systems are heavy and therefore they are presently firmly installed in fire engines.

It is the object of the present invention to provide a portable fire extinguishing apparatus which can be wheeled or even be carried and which utilizes pressurized gas foam stabilization like the CAFS systems installed in fire engines and which has the same advantages but which can be used in connection with portable fire extinguishers.

Known portable fire extinguishers for liquid extinguishing media such as water or foam operate in accordance with the principle that the extinguishing medium is driven out of the extinguishing medium container by a gas (carbon dioxide, nitrogen or compressed air) from a compressed gas bottle. With appropriate pressures and nozzles, a greater foaming and water atomization can be achieved. The above-described properties of CAFS systems, however, cannot be achieved by any presently known portable fire extinguishing apparatus.

SUMMARY OF THE INVENTION

In a portable foam fire extinguisher with pressurized foam stabilization, including a container for the fire extinguishing medium, a pressurized gas bottle in communication with the container and a fire extinguisher gun connected to the container by a hose for supplying the fire extinguishing medium to the fire extinguisher gun, a mixing device is provided which is connected, by way of a pressure hose, to the pressurized gas bottle for admixing pressurized gas to the flow of the fire extinguishing medium to the fire extinguisher gun to provide in the fire extinguishing medium pressurized gas bubbles, which expand when the mixture is discharged from the gun thereby accelerating the flow from the gun while forming a foam which adheres to the surfaces covered thereby.

With the fire extinguishing apparatus with CAFS properties according to the invention, a multitude of improvements are achieved. The foam obtained with the apparatus has an atomization spectrum with smaller droplet size. The foam droplets produced thereby can therefore better enter the burning material; the foam has a greater residence time and good wetting effects which improves extinguishing capability. The fire extinguishing apparatus according to the invention is very effective for materials of the fire classes A and B.

With the apparatus according to the invention, drive gas is admitted in a dosed manner. The foam generated thereby is pressurized gas stabilized and strongly adheres to the burning materials because of its homogeneous foam bubble structure. The foam adherence to vertical or ceiling surfaces is particularly improved so that the foam adheres to these surfaces for some time and can therefore be used much more effectively than water. Tests have shown that the pressure gas stabilized foam as produced by the apparatus according to the invention adheres even to glass panels for an extended period of time.

An embodiment of the invention will be described below in greater detail on the basis of the accompanying drawings.

BRIEF DESCRIPTION OF THE DRAWINGS

The sole FIGURE is a side view of a fire extinguishing gun with a medium supply and supply lines extending to a mixing structure.

DESCRIPTION OF A PARTICULAR EMBODIMENT

The FIGURE shows a fire extinguisher gun 1 with a spray nozzle 2. A fire extinguishing medium supply hose 3 extends from a fire extinguishing medium container 6 to a mixing device 4, which is connected to the gun 1. The mixing device 4 has the shape of a T-connector. A pressurized gas container 7 is also connected to the T-connector 4.

The fire extinguishing medium container is a pressure container 6, which is shown only schematically. It is filled with water with the addition of a foaming agent. A pressurized gas bottle 7 provided with a pressure control armature 8, which is also shown only schematically, is coupled to the extinguishing medium container 6 in a well-known manner. The armature of the pressurized gas bottle supplies pressurized gas, upon operation of the fire extinguisher, not only to the extinguishing medium container 6, but also to the mixing device 4.

Portable fire extinguishers generally operate with operating pressures of maximally 16 to 18 bar. The fire extinguisher according to the present invention is operated in a high-pressure range of 25 to 35 bar.

Preferably, the fire extinguisher according to the invention is constructed on the basis of the foam fire extinguisher as disclosed in DE 196 46 562, which is an apparatus which can be rapidly re-filled by a user by replacement of the pressurized gas bottle connected to the apparatus by a plug-in connection.

Since in the extinguisher according to the invention, the pressurized gas is supplied from the pressurized gas bottle 7 not only to the fire extinguishing container 6 for driving the extinguishing medium, but, additionally, via the mixing device 4, into the extinguishing medium just ahead of the extinguisher gun 1, the extinguishing medium is intensity mixed with the pressurized gas and a highly pressurized extinguishing medium with small pressure gas bubbles finely distributed throughout the extinguishing medium is provided to the fire extinguishing gun 1. As shown in the figure, the pressurized gas is mixed with the extinguishing medium before reaching the gun nozzle 2 for the release of the pressurized mixture by activation of the operating lever 9.

The admixing of the pressurized gas into the fire extinguishing medium flow directly ahead of the fire extinguisher gun 1 occurs in a carefully dosed manner with exactly determined pressurized gas and extinguishing medium volume flow ratios. The adjustment thereof is provided for at the pressurized gas bottle armature 8. In order to achieve a good fire extinguishing result, the fire extinguishing medium flow volume should be at least about 19 l/min and a foaming number of at least 7.5 should be provided.

With the apparatus according to the invention, a foam is generated which adheres extremely well to the surfaces of the burning material and covers them for preventing their contact with air. With the pressurized gas additionally admitted to the fire extinguishing medium flow just ahead of the fire-extinguishing gun, a uniform mixture with small pressure gas bubbles is formed. Upon release through the discharge nozzle of the gun, the small bubbles expand causing a rapid acceleration of the extinguishing medium flow. The extinguishing medium droplets therefore reach a high speed resulting on a high penetration depth into the burning material and the expanding pressurized gas bubbles form a foam, which is moved along with the high speed droplets onto the burning material and firmly adhere to the surfaces of the material. The efficiency of the fire extinguisher according to the invention is therefore much increased as compared with prior art apparatus. It has been found that, to obtain the effects described, an operating pressure of 25 to 35 bar is particularly suitable.

What is claimed is:

1. A portable foam fire extinguisher with pressurized gas foam stabilization, comprising: a pressure resistant fire extinguishing medium container for containing water and a fire extinguishing foam agent, a pressure gas bottle in communication with said container for pressurizing the fire extinguishing medium in said container, a fire extinguisher gun, a fire extinguishing medium supply line including a hose extending between said fire extinguishing medium container and said fire extinguisher gun for supplying the fire extinguishing medium to said fire extinguisher gun, a mixing device arranged in said fire extinguishing supply line immediately ahead of, and connected directly to, said gun, and a pressurized gas hose extending from said pressurized gas bottle to said mixing device for admixing pressurized gas to said fire extinguishing medium entering said fire extinguisher gun to provide in said gun a uniform mixture of said fire extinguishing medium with small pressurized gas bubbles, which expand during the discharge of the mixture from said gun thereby greatly accelerating the fire extinguishing medium flow from said gun while expanding and forming stabilized foam, which firmly adheres to the surfaces covered thereby.

2. A foam fire extinguisher according to claim 1, wherein said pressure gas bottle is provided with a pressure control device for adjusting the pressurized gas distribution to the extinguishing container and the mixing device.

3. A foam fire extinguisher according to claim 1, wherein the operating pressure of said extinguisher is in the range of 25 to 35 bar.

* * * * *